US008104838B2

(12) United States Patent
Tsai

(10) Patent No.: US 8,104,838 B2
(45) Date of Patent: Jan. 31, 2012

(54) ARMREST ASSEMBLY THAT CAN ADJUST ITS LEFTWARD AND RIGHTWARD POSITIONS

(76) Inventor: Po-Chuan Tsai, Tainan Hsien (TW)

( * ) Notice: Subject to any disclaimer, the term of this patent is extended or adjusted under 35 U.S.C. 154(b) by 240 days.

(21) Appl. No.: 12/638,030

(22) Filed: Dec. 15, 2009

(65) Prior Publication Data

US 2011/0140498 A1 Jun. 16, 2011

(51) Int. Cl.
*A47C 7/54* (2006.01)

(52) U.S. Cl. ..... 297/411.37; 297/383

(58) Field of Classification Search ..... 297/353, 297/383, 411.37; 248/118, 188.5, 411; 403/109.5, 403/373

See application file for complete search history.

(56) References Cited

U.S. PATENT DOCUMENTS 4,536,031 A * 8/1985 Latone ..... 297/353
4,932,622 A * 6/1990 Hayakawa ..... 248/188.5
5,462,338 A * 10/1995 Baumann ..... 297/411.37
5,660,442 A * 8/1997 Tornero ..... 297/411.36
5,944,387 A * 8/1999 Stumpf ..... 297/411.37
6,296,313 B1 * 10/2001 Wu ..... 297/411.35
6,409,266 B1 * 6/2002 Chen ..... 297/411.37
6,572,195 B1 * 6/2003 Lee ..... 297/411.37
6,659,560 B1 * 12/2003 Chi ..... 297/383
7,243,997 B1 * 7/2007 Tornero ..... 297/411.37

* cited by examiner

*Primary Examiner* — Peter R. Brown
(74) *Attorney, Agent, or Firm* — Alan Kamrath; Kamrath IP Lawfirm, PA

(57) ABSTRACT

An armrest assembly includes a mounting bracket, a limit member mounted on the mounting bracket, and an armrest support mounted on the limit member. The bottom of the mounting bracket is provided with a slideway which has a first side provided with an upright limit face and a second side provided with an oblique limit face. The limit member has a first side provided with an upright mating face abutting the upright limit face and a second side provided with an oblique mating face abutting the oblique limit face. Thus, the upright mating face and the oblique mating face are limited by the upright limit face and the oblique limit face respectively, so that the limit member is moved in the slideway smoothly and stably without producing any vibration to facilitate movement of the armrest support relative to the mounting bracket.

17 Claims, 7 Drawing Sheets

ARMREST ASSEMBLY THAT CAN ADJUST ITS LEFTWARD AND RIGHTWARD POSITIONS

BACKGROUND OF THE INVENTION

1. Field of the Invention

The present invention relates to an armrest assembly and, more particularly, to an armrest assembly for a chair and the like.

2. Description of the Related Art

A conventional armrest assembly 1 in accordance with the prior art shown in FIG. 7 comprises a mounting bracket 2 having an inner portion provided with a receiving chamber 21, an armrest support 10 mounted on the mounting bracket 2 and having a transverse section provided with a plug 101 inserted into the receiving chamber 21 of the mounting bracket 2, and a threaded fastening knob 3 rotatably mounted on the mounting bracket 2 and extending through the plug 101 of the armrest support 10 to releasably lock the plug 101 of the armrest support 10 onto the mounting bracket 2. In operation, when the fastening knob 3 is tightened onto the mounting bracket 2, the plug 101 of the armrest support 10 is locked onto the mounting bracket 2. On the contrary, when the fastening knob 3 is loosened from the mounting bracket 2, the plug 101 of the armrest support 10 is unlocked from the mounting bracket 2. Thus, the plug 101 of the armrest support 10 is moved relative to the mounting bracket 2 to adjust the position of the armrest support 10 relative to the mounting bracket 2 so as to adjust the position of the armrest (not shown) supported by the armrest support 10. However, the plug 101 of the armrest support 10 is not supported by the mounting bracket 2 smoothly and stably so that the plug 101 of the armrest support 10 is easily vibrated or swayed during movement, thereby causing inconvenience to a user when adjusting the position of the armrest support 10.

BRIEF SUMMARY OF THE INVENTION

In accordance with the present invention, there is provided an armrest assembly, comprising a mounting bracket, a limit member movably mounted on a bottom of the mounting bracket, and an armrest support mounted on the limit member to move with the limit member relative to the mounting bracket. The bottom of the mounting bracket is provided with an elongate slideway. The slideway of the mounting bracket has a first side provided with an upright limit face and a second side provided with an oblique limit face located opposite to the upright limit face. The limit member is slidably mounted in the slideway of the mounting bracket. The limit member has a first side provided with an upright mating face abutting the upright limit face of the mounting bracket and a second side provided with an oblique mating face located opposite to the upright mating face and abutting the oblique limit face of the mounting bracket.

The primary objective of the present invention is to provide an armrest assembly that can adjust its leftward and rightward positions.

According to the primary objective of the present invention, when the limit member is moved in the slideway of the mounting bracket, the upright mating face and the oblique mating face of the limit member are limited by the upright limit face and the oblique limit face of the mounting bracket respectively, so that the limit member is moved in the slideway of the mounting bracket smoothly and stably without producing any vibration or sway to facilitate movement of the armrest support relative to the mounting bracket.

According to another objective of the present invention, the first guide slot and the second guide slot of the limit member are moved on the threaded rod to limit movement of the limit member, and the sliding slot of the armrest support is moved on the threaded rod to limit movement of the plug of the armrest support.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
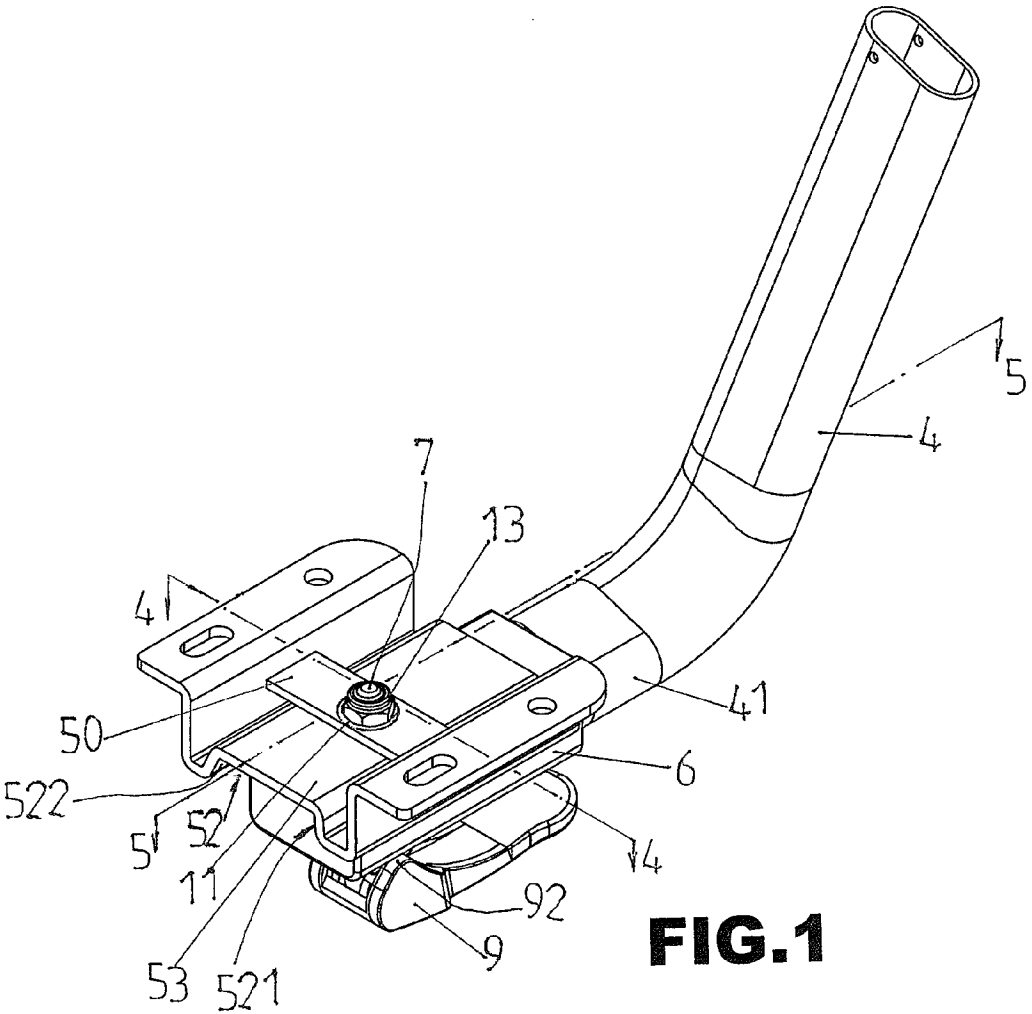
FIG. 1 is a perspective view of an armrest assembly in accordance with the preferred embodiment of the present invention.
Figure 2:
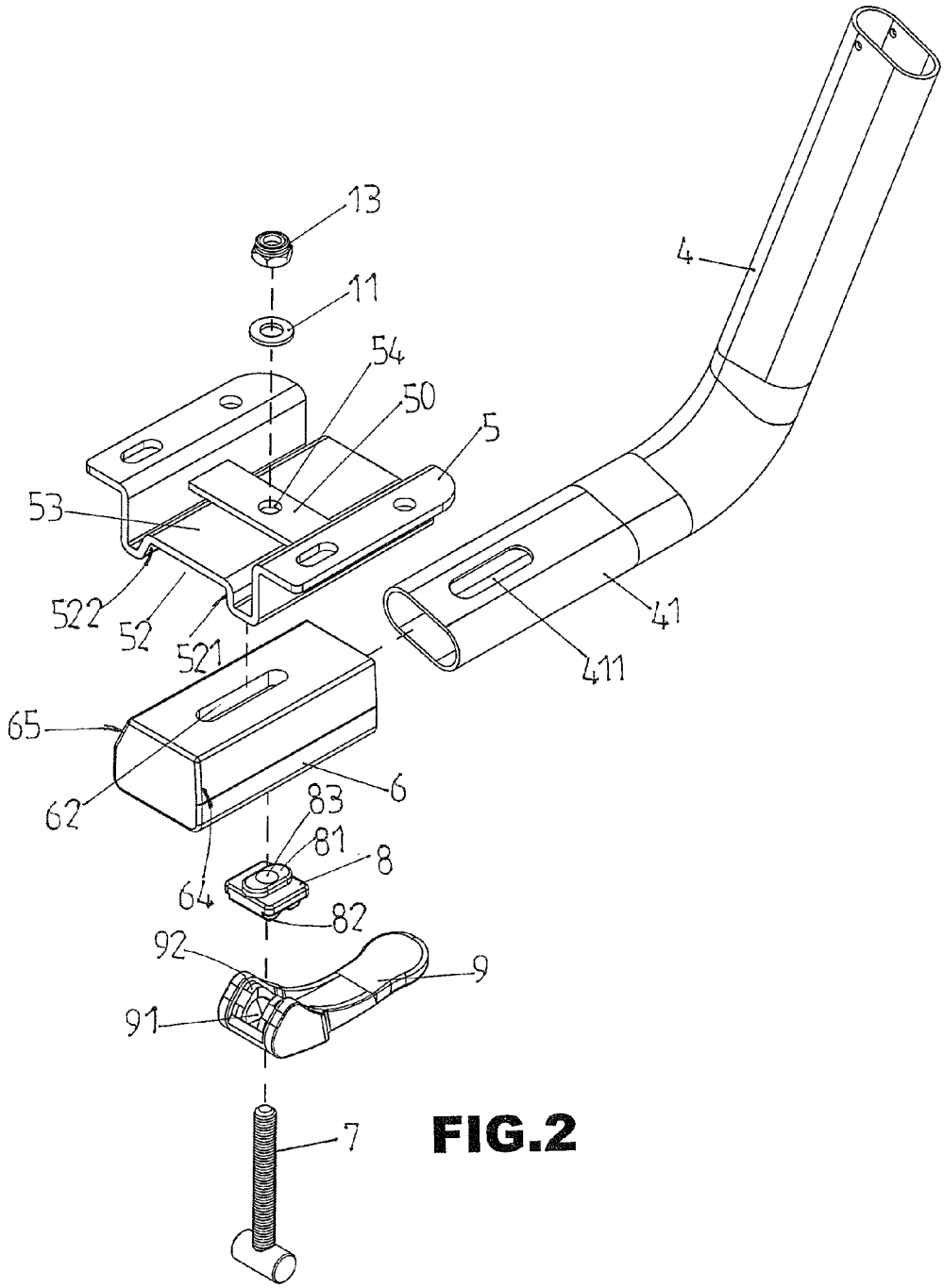
FIG. 2 is an exploded perspective view of the armrest assembly as shown in FIG. 1.
Figure 3:
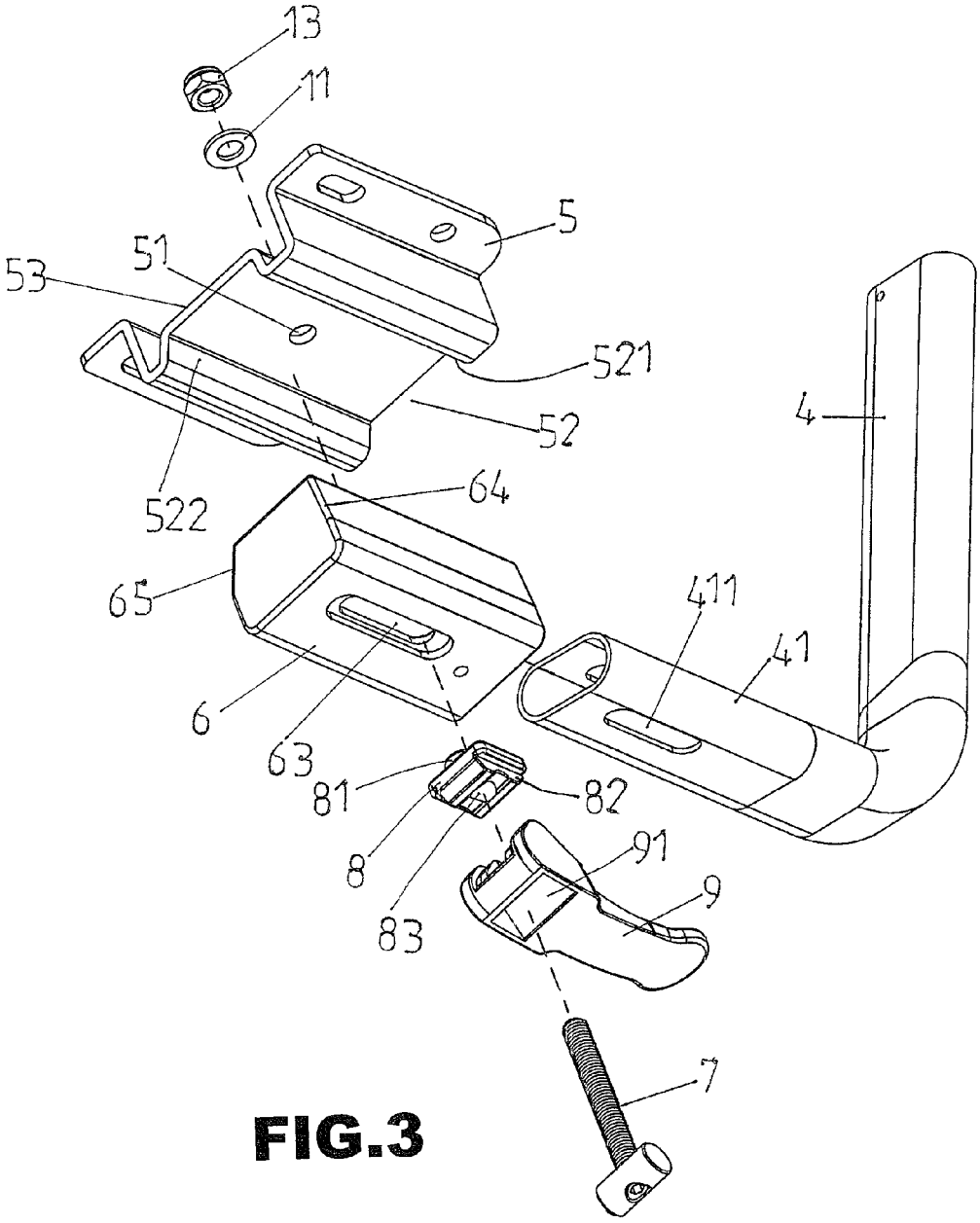
FIG. 3 is another exploded perspective view of the armrest assembly as shown in FIG. 1.
Figure 4:
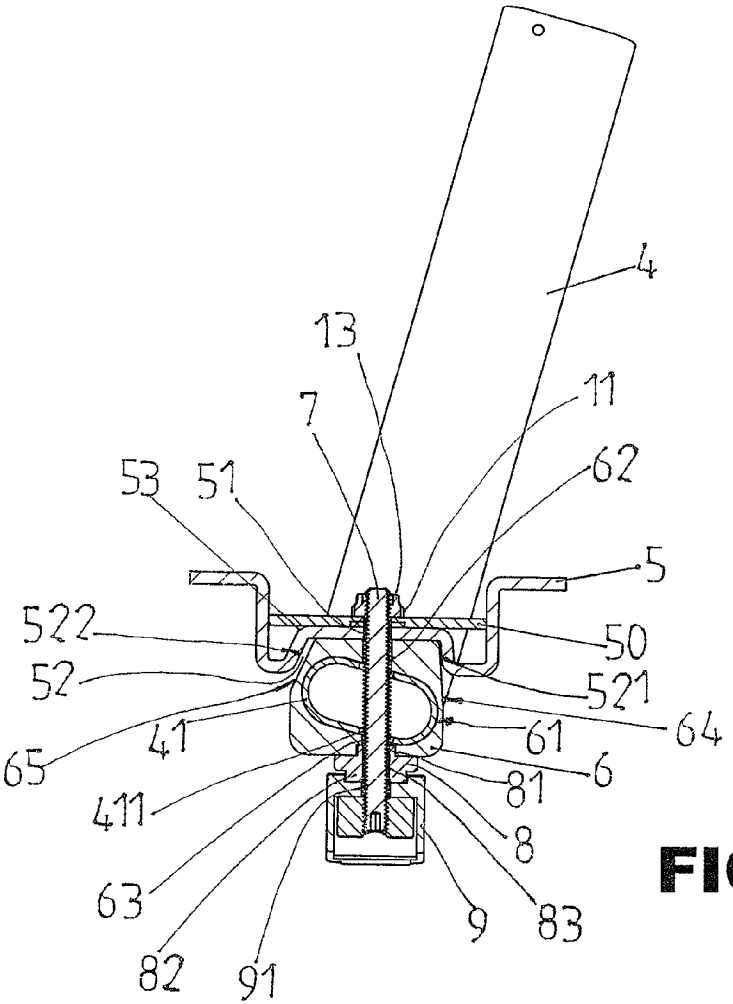
FIG. 4 is a cross-sectional view of the armrest assembly taken along line 4-4 as shown in FIG. 1.

Referring to the drawings and initially to FIGS. 1-5, an armrest assembly in accordance with the preferred embodiment of the present invention comprises a mounting bracket 5, a limit member 6 movably mounted on a bottom of the mounting bracket 5, an armrest support 4 mounted on the limit member 6 to move with the limit member 6 relative to the mounting bracket 5, a threaded rod 7 extending through the limit member 6, the armrest support 4 and the mounting bracket 5 to attach the limit member 6 and the armrest support 4 to the mounting bracket 5, a fastening nut 13 screwed onto the threaded rod 7, a washer 11 mounted on the threaded rod 7 and located between the fastening nut 13 and the mounting bracket 5, a pressing member 8 mounted on the threaded rod 7 and abutting the limit member 6, and a control handle 9 pivotally mounted on the threaded rod 7 and eccentrically abutting the pressing member 8 to tighten or loosen the pressing member 8 so as to lock the limit member 6 and the armrest support 4 onto the mounting bracket 5 or to unlock the limit member 6 and the armrest support 4 from the mounting bracket 5.

The mounting bracket 5 has a substantially U-shaped profile. The bottom of the mounting bracket 5 is provided with an elongate slideway 52. The slideway 52 of the mounting bracket 5 is formed by a protruding support flange 53 which extends upward from the bottom of the mounting bracket 5. The support flange 53 of the mounting bracket 5 has a substantially inverted U-shaped profile. The slideway 52 of the mounting bracket 5 has a first side provided with an upright limit face 521 and a second side provided with an oblique limit face 522 located opposite to the upright limit face 521. The mounting bracket 5 has a mediate portion provided with a fixing hole 51 connected to the slideway 52 to allow passage of the threaded rod 7.

The armrest assembly further comprises a connecting plate 50 mounted in the mounting bracket 5 and located between the mounting bracket 5 and the washer 11. The connecting plate 50 has a mediate portion provided with a through hole 54 connected to the fixing hole 51 of the mounting bracket 5 to allow passage of the threaded rod 7.

The limit member 6 is slidably mounted in the slideway 52 of the mounting bracket 5. The limit member 6 has a first side provided with an upright mating face 64 abutting the upright limit face 521 of the mounting bracket 5 and a second side provided with an oblique mating face 65 located opposite to the upright mating face 64 and abutting the oblique limit face 522 of the mounting bracket 5. The oblique mating face 65 of the limit member 6 has an inclined angle equal to that of the oblique limit face 522 of the mounting bracket 5. The limit member 6 has an inner portion provided with a receiving chamber 61 to allow insertion of the armrest support 4 and to allow passage of the threaded rod 7. The receiving chamber 61 of the limit member 6 has a substantially oblique oblong profile. The limit member 6 has a top provided with an elongate first guide slot 62 slidable on the threaded rod 7 and a bottom provided with an elongate second guide slot 63 slidable on the threaded rod 7. The first guide slot 62 of the limit member 6 is connected to the receiving chamber 61 of the limit member 6. The second guide slot 63 of the limit member 6 is connected to the receiving chamber 61 of the limit member 6 and is aligned with the first guide slot 62 of the limit member 6. Preferably, the second guide slot 63 of the limit member 6 has a substantially inverted T-shaped profile.

The armrest support 4 has a transverse section provided with a plug 41 inserted into and secured in the receiving chamber 61 of the limit member 6. The plug 41 of the armrest support 4 has a substantially oblong profile and has a surface provided with an elongate sliding slot 411 slidable on the threaded rod 7. The sliding slot 411 of the armrest support 4 is aligned with the first guide slot 62 and the second guide slot 63 of the limit member 6.

The threaded rod 7 in turn extends through the control handle 9, the pressing member 8, the limit member 6, the armrest support 4, the mounting bracket 5 and the washer 11 and is screwed into the fastening nut 13.

The control handle 9 has an end portion provided with a pivot hole 91 pivotally mounted on the threaded rod 7 and an eccentrically arranged pressing edge 92 abutting the pressing member 8 to press or release the pressing member 8 by pivot of the control handle 9 relative to the threaded rod 7.

The pressing member 8 has a mediate portion provided with a through bore 83 to allow passage of the threaded rod 7. The pressing member 8 has a top provided with a protrusion 81 inserted into the second guide slot 63 of the limit member 6 and a bottom provided with a projection 82 inserted into the pivot hole 91 of the control handle 9.

Figure 5:
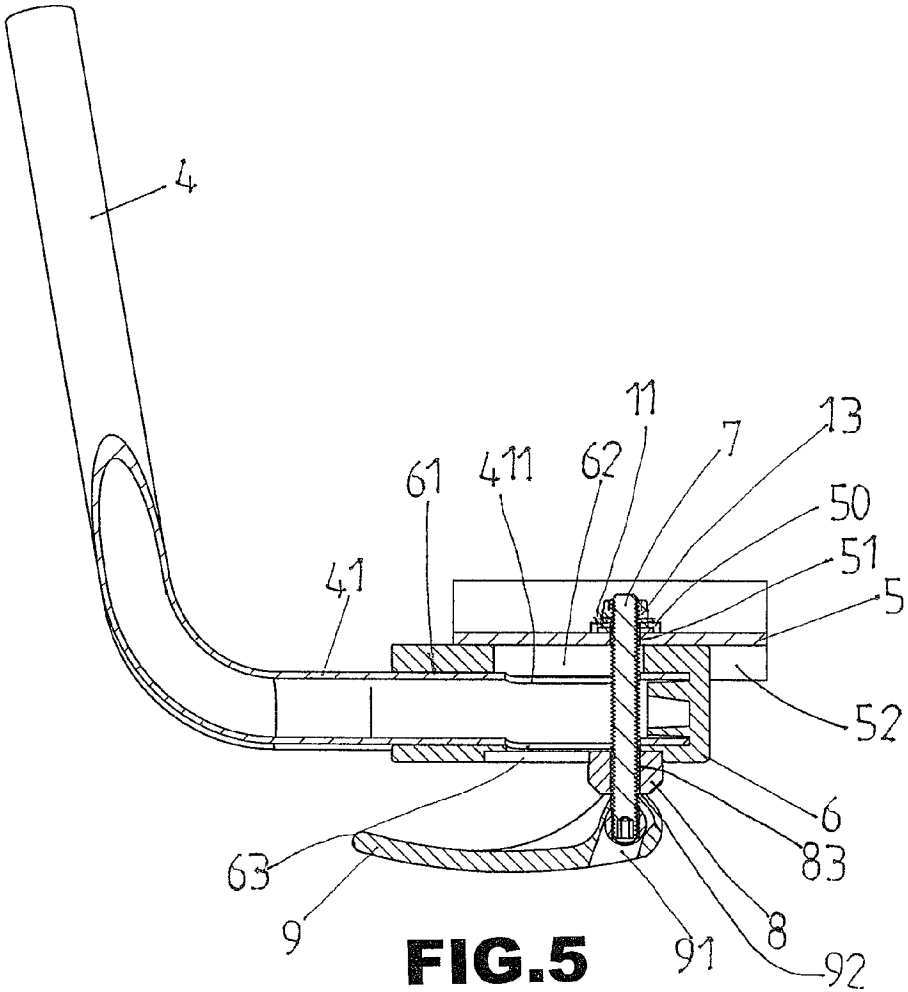
FIG. 5 is a cross-sectional view of the armrest assembly taken along line 5-5 as shown in FIG. 1.
Figure 6:
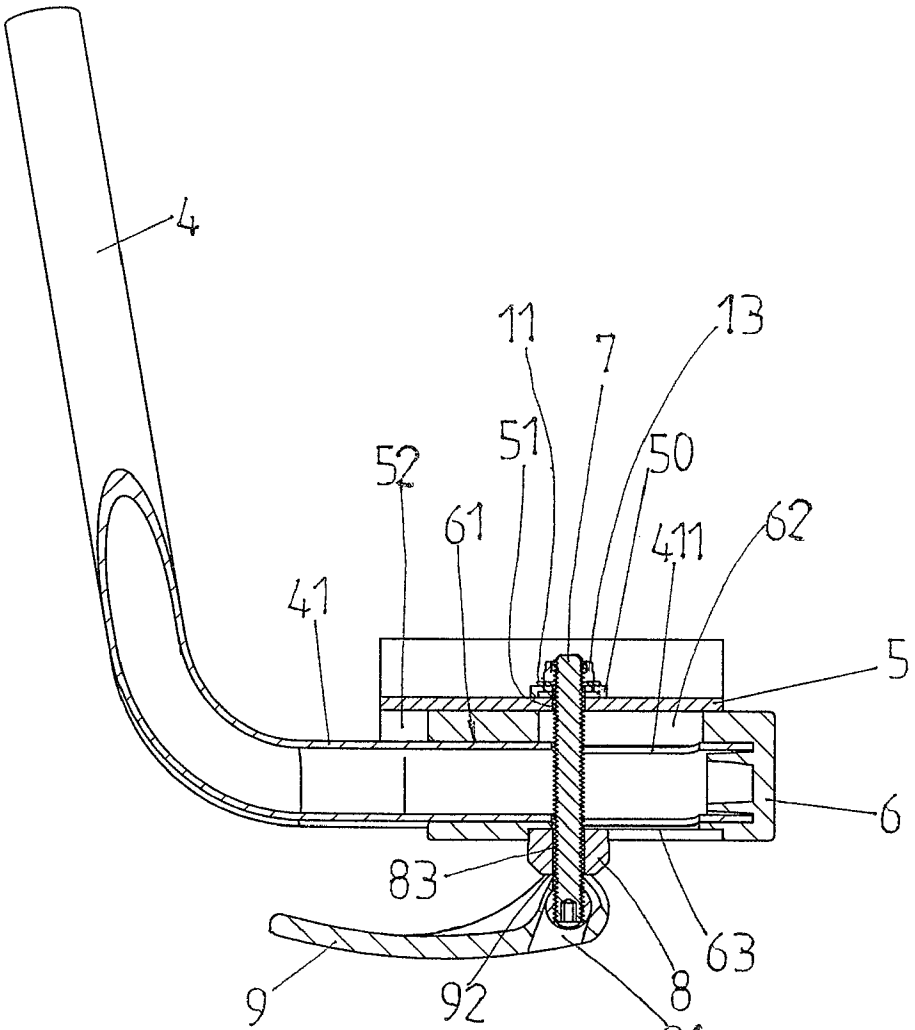
FIG. 6 is a schematic operational view of the armrest assembly as shown in FIG. 5.
Figure 7:
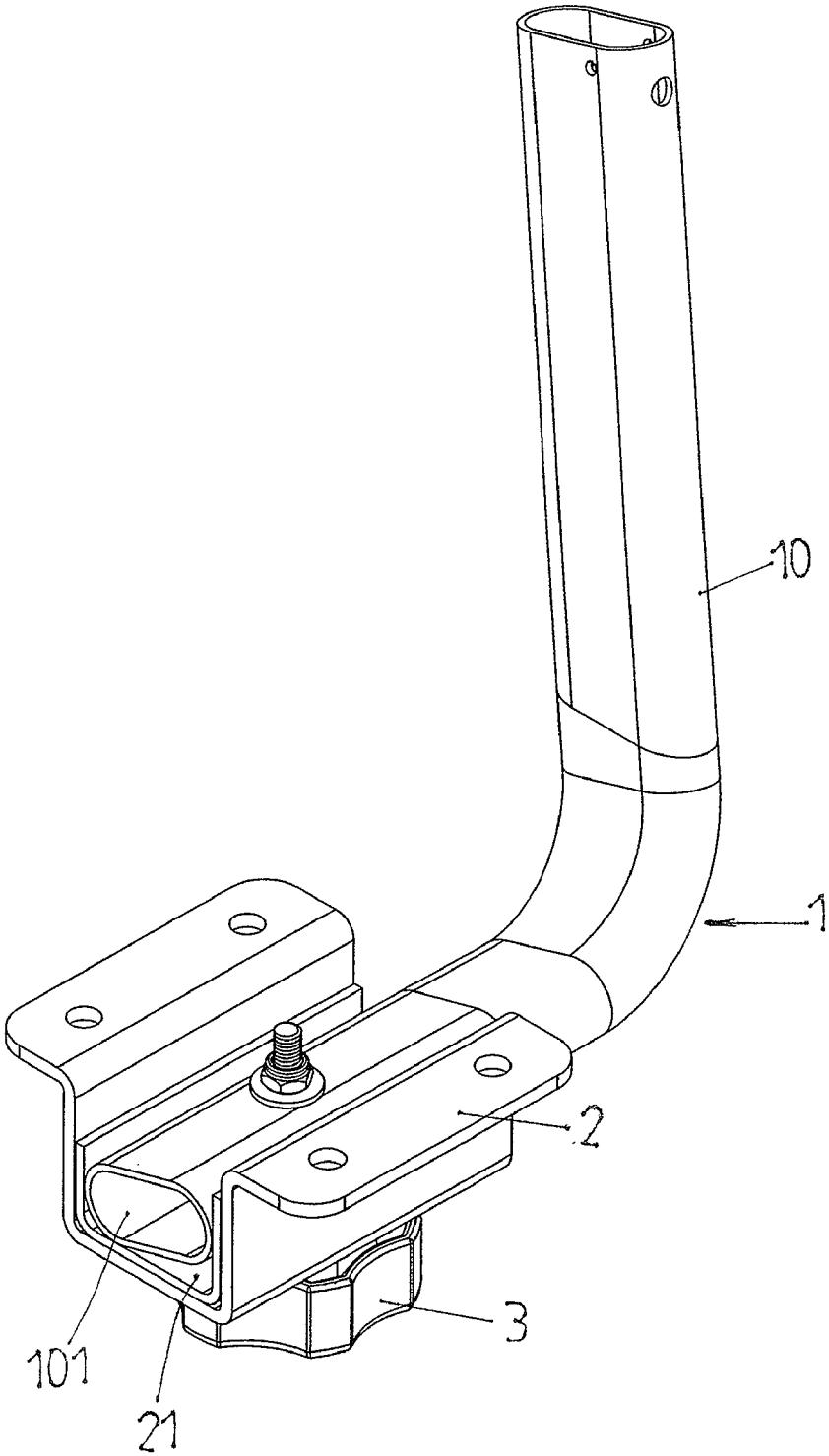
FIG.7 PRIOR ART
FIG. 7 is a perspective view of a conventional armrest assembly in accordance with the prior art.

In operation, referring to FIGS. 5 and 6 with reference to FIGS. 1-4, when the control handle 9 is pushed toward the limit member 6, the pressing edge 92 of the control handle 9 is pivoted and moved eccentrically to press the pressing member 8 by pivot of the control handle 9 as shown in FIG. 5 so as to compress the limit member 6 toward the mounting bracket 5 so that the plug 41 of the armrest support 4 and the limit member 6 are locked onto the mounting bracket 5.

On the contrary, when the control handle 9 is pulled outward relative to the limit member 6, the pressing edge 92 of the control handle 9 is pivoted and moved eccentrically to release the pressing member 8 by pivot of the control handle 9 so as to release the limit member 6 from the mounting bracket so that the plug 41 of the armrest support 4 and the limit member 6 are unlocked from the mounting bracket 5.

In such a manner, the limit member 6 is loosened from the mounting bracket 5 and is moved in the slideway 52 of the mounting bracket 5, and the plug 41 of the armrest support 4 is moved with the limit member 6 so that the plug 41 of the armrest support 4 is moved relative to the mounting bracket 5 from the position as shown in FIG. 5 to the position as shown in FIG. 6 so as to adjust the position of the armrest support 4 relative to the mounting bracket 5 and to adjust the position of the armrest (not shown) supported by the armrest support 4. At this time, the first guide slot 62 and the second guide slot 63 of the limit member 6 are moved on the threaded rod 7 to limit movement of the limit member 6, and the sliding slot 411 of the armrest support 4 is moved on the threaded rod 7 to limit movement of the plug 41 of the armrest support 4.

After the position adjustment of the armrest support 4 is achieved, the control handle 9 is again pushed toward the limit member 6, and the pressing edge 92 of the control handle 9 is pivoted and moved eccentrically to press the pressing member 8 by pivot of the control handle 9 so as to compress the limit member 6 toward the mounting bracket 5 so that the plug 41 of the armrest support 4 and the limit member 6 are again locked onto the mounting bracket 5 as shown in FIG. 6.

Accordingly, when the limit member 6 is moved in the slideway 52 of the mounting bracket 5, the upright mating face 64 and the oblique mating face 65 of the limit member 6 are limited by the upright limit face 521 and the oblique limit face 522 of the mounting bracket 5 respectively, so that the limit member 6 is moved in the slideway 52 of the mounting bracket 5 smoothly and stably without producing any vibration or sway to facilitate movement of the armrest support 4 relative to the mounting bracket 5. In addition, the first guide slot 62 and the second guide slot 63 of the limit member 6 are moved on the threaded rod 7 to limit movement of the limit member 6, and the sliding slot 411 of the armrest support 4 is moved on the threaded rod 7 to limit movement of the plug 41 of the armrest support 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest assembly, comprising:

a mounting bracket;

a limit member movably mounted on a bottom of the mounting bracket;

an armrest support mounted on the limit member to move with the limit member relative to the mounting bracket;

wherein the bottom of the mounting bracket is provided with an elongate slideway;

the slideway of the mounting bracket has a first side provided with an upright limit face and a second side provided with an oblique limit face located opposite to the upright limit face;

the limit member is slidably mounted in the slideway of the mounting bracket;

the limit member has a first side provided with an upright mating face abutting the upright limit face of the mounting bracket and a second side provided with an oblique mating face located opposite to the upright mating face and abutting the oblique limit face of the mounting bracket.

2. The armrest assembly of claim 1, wherein the oblique mating face of the limit member has an inclined angle equal to that of the oblique limit face of the mounting bracket.

3. The armrest assembly of claim 1, further comprising:

a threaded rod extending through the limit member, the armrest support and the mounting bracket to attach the limit member and the armrest support to the mounting bracket;

a fastening nut screwed onto the threaded rod;

a washer mounted on the threaded rod and located between the fastening nut and the mounting bracket;

a pressing member mounted on the threaded rod and abutting the limit member;

a control handle pivotally mounted on the threaded rod and eccentrically abutting the pressing member to tighten or loosen the pressing member so as to lock the limit member and the armrest support onto the mounting bracket or to unlock the limit member and the armrest support from the mounting bracket.

4. The armrest assembly of claim 3, wherein the limit member has an inner portion provided with a receiving chamber to allow insertion of the armrest support and to allow passage of the threaded rod;

the armrest support has a transverse section provided with a plug inserted into and secured in the receiving chamber of the limit member.

5. The armrest assembly of claim 4, wherein the receiving chamber of the limit member has a substantially oblique oblong profile;

the plug of the armrest support has a substantially oblong profile.

6. The armrest assembly of claim 4, wherein the limit member has a top provided with an elongate first guide slot slidable on the threaded rod and a bottom provided with an elongate second guide slot slidable on the threaded rod;

the plug of the armrest support has a surface provided with an elongate sliding slot slidable on the threaded rod.

7. The armrest assembly of claim 6, wherein the first guide slot of the limit member is connected to the receiving chamber of the limit member;

the second guide slot of the limit member is connected to the receiving chamber of the limit member and is aligned with the first guide slot of the limit member;

the sliding slot of the armrest support is aligned with the first guide slot and the second guide slot of the limit member.

8. The armrest assembly of claim 6, wherein the second guide slot of the limit member has a substantially inverted T-shaped profile.

9. The armrest assembly of claim 6, wherein the mounting bracket has a mediate portion provided with a fixing hole connected to the slideway to allow passage of the threaded rod;

the pressing member has a mediate portion provided with a through bore to allow passage of the threaded rod;

the control handle has an end portion provided with a pivot hole pivotally mounted on the threaded rod.

10. The armrest assembly of claim 9, wherein the threaded rod in turn extends through the control handle, the pressing member, the limit member, the armrest support, the mounting bracket and the washer and is screwed into the fastening nut.

11. The armrest assembly of claim 9, wherein the pressing member has a top provided with a protrusion inserted into the second guide slot of the limit member and a bottom provided with a projection inserted into the pivot hole of the control handle.

12. The armrest assembly of claim 9, wherein the end portion of the control handle has an eccentrically arranged pressing edge abutting the pressing member to press or release the pressing member by pivot of the control handle relative to the threaded rod.

13. The armrest assembly of claim 9, further comprising:

a connecting plate mounted in the mounting bracket and located between the mounting bracket and the washer.

14. The armrest assembly of claim 13, wherein the connecting plate has a mediate portion provided with a through hole connected to the fixing hole of the mounting bracket to allow passage of the threaded rod.

15. The armrest assembly of claim 1, wherein the mounting bracket has a substantially U-shaped profile.

16. The armrest assembly of claim 1, wherein the slideway of the mounting bracket is formed by a protruding support flange which extends upward from the bottom of the mounting bracket.

17. The armrest assembly of claim 16, wherein the support flange of the mounting bracket has a substantially inverted U-shaped profile.

* * * * *